US008814124B1

(12) United States Patent
Vayntraub

(10) Patent No.: US 8,814,124 B1
(45) Date of Patent: Aug. 26, 2014

(54) ARTICLE HANGING DEVICE

(76) Inventor: Vladimir Vayntraub, Los Angeles, CA (US)

( * ) Notice: Subject to any disclaimer, the term of this patent is extended or adjusted under 35 U.S.C. 154(b) by 250 days.

(21) Appl. No.: 12/710,931

(22) Filed: Feb. 23, 2010

(51) Int. Cl.
*A47G 1/16* (2006.01)
*A47G 1/24* (2006.01)

(52) U.S. Cl.
USPC ..... 248/496; 248/477; 248/489

(58) Field of Classification Search
USPC ..... 248/479, 489, 466, 467, 475.1, 477, 248/496, 497, 220.21, 225.11, 314, 481, 248/495; 359/871
See application file for complete search history.

(56) References Cited

U.S. PATENT DOCUMENTS

| | | | | |
|---|---|---|---|---|
| 2,757,890 | A * | 8/1956 | Sutton et al. | 248/494 |
| 3,529,799 | A * | 9/1970 | Schaefer | 248/496 |
| 3,861,639 | A * | 1/1975 | Morrill | 248/489 |
| 3,955,790 | A * | 5/1976 | Ballin | 248/489 |
| 4,040,593 | A | 8/1977 | Wiley | |
| D251,286 | S | 3/1979 | Cook | |
| 4,171,117 | A | 10/1979 | Prochaska | |
| D257,219 | S | 10/1980 | Cook | |
| 4,434,565 | A | 3/1984 | Haley | |
| 4,437,639 | A * | 3/1984 | Stein | 248/558 |
| 4,611,780 | A | 9/1986 | Robertson | |
| 5,605,313 | A * | 2/1997 | Erickson et al. | 248/467 |
| 5,957,421 | A * | 9/1999 | Barbour | 248/220.21 |
| 5,983,467 | A * | 11/1999 | Duffy | 24/442 |
| 6,454,235 | B1 | 9/2002 | O'Banion | |
| 6,578,812 | B2 | 6/2003 | Lemire | |
| 6,710,260 | B1 * | 3/2004 | Seki et al. | 174/258 |
| 6,769,660 | B2 * | 8/2004 | DeLine | 248/542 |
| 7,565,746 | B2 * | 7/2009 | Yeh | 30/226 |
| 8,096,520 | B2 * | 1/2012 | Sohn et al. | 248/558 |
| 8,413,948 | B2 * | 4/2013 | Kemeny | 248/566 |
| 2008/0078915 | A1 | 4/2008 | Haje | |

* cited by examiner

*Primary Examiner* — Tan Le
(74) *Attorney, Agent, or Firm* — QuickPatents; Kevin Prince

(57) ABSTRACT

A system for securing a maintaining an article, such as a picture frame, in a desired position on a vertical surface, such as a wall, is disclosed. The system comprises a first bracket and a second bracket. The first bracket has a first part of a pivot and includes at least one projecting nub. The second bracket has a second part of the pivot and at least one divot that are each cooperative with one of the at least one projecting nubs. In use, the first and second brackets are each fixed to either a rear surface of the article proximate a top edge thereof, or to the vertical surface. Each nub of the first bracket engages the cooperative divot of the second bracket when the article is in the desired position on the vertical surface. When jarred, the article pivots back and forth about the pivot until each nub becomes re-engaged with its cooperative divot, by gravity, to bring the article back into the desired position.

9 Claims, 3 Drawing Sheets

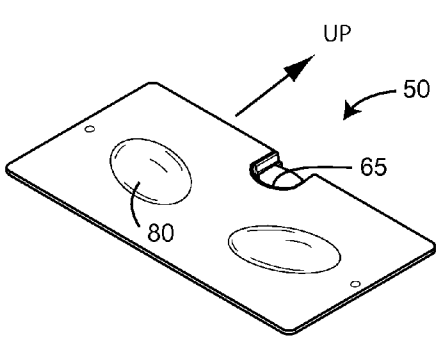
FIG. 6
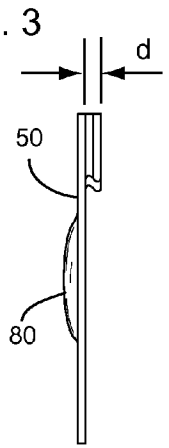
FIG. 5
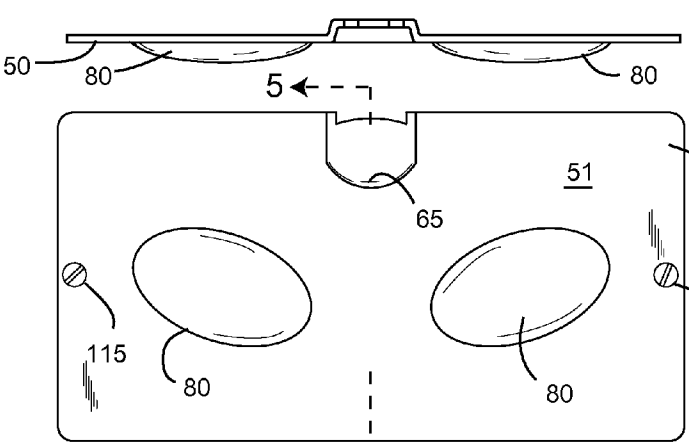
FIG. 3
FIG. 4
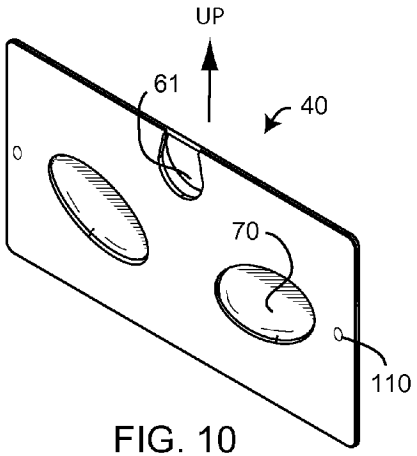
FIG. 10
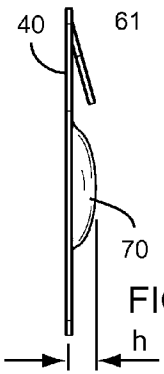
FIG. 9
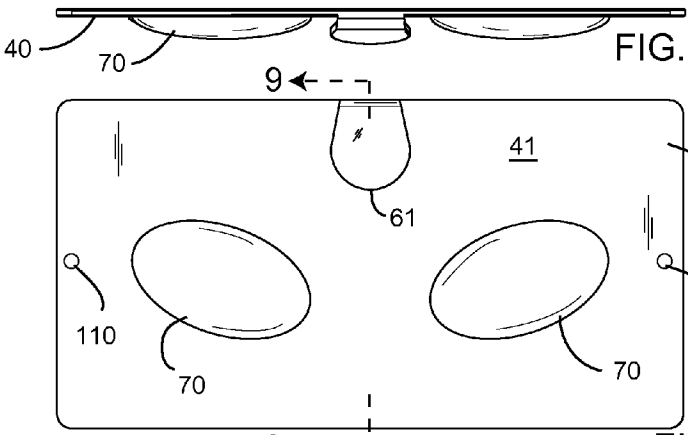
FIG. 7
FIG. 8

ARTICLE HANGING DEVICE

CROSS-REFERENCE TO RELATED APPLICATIONS

Not Applicable.

STATEMENT REGARDING FEDERALLY SPONSORED RESEARCH AND DEVELOPMENT

Not Applicable.

FIELD OF THE INVENTION

This invention relates to picture hanging, and more particularly to a system for hanging an article such as a picture frame on a vertical surface and maintaining same in a desired position.

DISCUSSION OF RELATED ART

A nail or screw is typically used to hang a picture frame or other article on a wall surface, the nail after being pounded into the wall projecting enough to allow a clasp on the the picture frame may not be precisely centered on the picture frame, wherein gravity over time causes the picture to tilt away from level until the center of gravity aligns with the nail. To overcome this drawback, the conventional "sawtooth" type of clasp has been widely used, such a claps providing a plurality of pivot points about the nail such that one such pivot point may be selected that is closest to the vertical center of gravity of the picture frame. However, such a device still suffers from the drawback that if the picture frame is jarred it may not return to level due to friction of the picture frame against the wall. That is, gravity may not act sufficiently on the picture frame to overcome the friction of the lower edge of the picture frame against the wall to cause the picture frame to return to a level orientation. The object hangers taught in U.S. Pat. No. 5,605,313 to Erickson et al. on Feb. 25, 1997, and U.S. Pat. No. 4,611,780 to Robertson on Sep. 16, 1986, suffer from the same drawbacks.

The prior art is replete with devices for overcoming this drawback. For example, U.S. Patent Application 2008/0078915 to Haje on Apr. 3, 2008, teaches a two-piece hanger device that serves to prevent the picture frame from moving once its level orientation is established. However, such a device merely transfers the force of a jarring impact from the picture frame to the hanger device, possibly damaging the picture frame, the hanger device, the wall surface to which it is attached, or all three. Such a device, when in use, results in two relatively proximate contact points between each piece of the hanger device. Depending on the height of the picture frame, a significant moment arm results about the top contact point with such a device, and it is the lower part of the picture frame that tends to be inadvertently jarred by passersby. Thus such a device is not reliable and can lead to damage of the picture frame and wall surfaces to which it is mounted.

The positioning and locking hanging system taught in U.S. Pat. No. 6,578,812 to Lemire on Jun. 17, 2003, suffers from many of the same drawbacks. Further, such a device has numerous parts and is therefore expensive to manufacture and relatively complicated to use.

Therefore, there is a need for a hanging system that, when the picture frame is jarred, allows the picture frame to return to its original desired orientation reliably. Such a needed system would be relatively inexpensive to manufacture, and easy to install and use. Such a needed system would not be able to damage either the picture frame or the wall in the event of a particularly strong jarring of the picture frame. The present invention accomplishes these objectives.

SUMMARY OF THE INVENTION

The present device is a system for securing a maintaining an article, such as a picture frame, in a desired position on a vertical surface, such as a wall. Typically the desired position is with the article level, for example. Such an article includes at least a rear surface, a top edge, and a bottom edge.

The system comprises a first bracket and a second bracket. The first bracket has a first part of a pivot and includes at least one projecting nub, and preferably at least two such nubs. The second bracket has a second part of the pivot and at least one divot (or aperture), and preferably two divots, that are each cooperative with one of the at least one projecting nubs.

In use, the first and second brackets are each fixed to either the rear surface of the article proximate the top edge thereof, or to the vertical surface. Either of the first or second brackets may be fixed to the article, for example, the other bracket being fixed to the vertical surface. Each nub of the first bracket engages the cooperative divot of the second bracket when the article is in the desired position on the vertical surface.

When jarred, the article pivots back and forth about the pivot until each nub becomes re-engaged with its cooperative divot, by gravity, to bring the article back into the originally installed or desired position. The contact points of the at least one nub with the second bracket result in minimal friction, allowing the first and second brackets to mutually rotate about the pivot until gravity causes the nubs and the divots to become re-engaged, guaranteeing that the article will assume the desired position when the article is jarred, such as through inadvertent contact, earthquake, or the like.

The present invention is a hanging system that, when the picture frame is jarred, allows the picture frame to return to its level orientation reliably. The present system is relatively inexpensive to manufacture, and easy to install and use. The present invention does not result in damage to either the picture frame or the wall in the event of a particularly strong jarring of the picture frame. Further, when multiple picture frames are installed at one location with the present invention, such picture frames may be readily interchanged to vary the display of the multiple picture frames, each first bracket being functional with the second bracket of other articles. Other features and advantages of the present invention will become apparent from the following more detailed description, taken in conjunction with the accompanying drawings, which illustrate, by way of example, the principles of the invention.

DESCRIPTION OF THE DRAWINGS

FIG. 3 is a top plan view of a first bracket thereof;

FIG. 4 is a front elevational view thereof;

FIG. 5 is a cross-sectional view thereof, taken generally along lines 5-5 of FIG. 4;

FIG. 6 is a perspective view thereof;

FIG. 7 is a top plan view of a second bracket thereof;

FIG. 8 is a front elevational view thereof;

FIG. 9 is a cross-sectional view thereof, taken generally along lines 9-9 of FIG. 8;

FIG. 10 is a perspective view thereof;

DETAILED DESCRIPTION OF THE PREFERRED EMBODIMENT

Illustrative embodiments of the invention are described below. The following explanation provides specific details for a thorough understanding of and enabling description for these embodiments. One skilled in the art will understand that the invention may be practiced without such details. In other instances, well-known structures and functions have not been shown or described in detail to avoid unnecessarily obscuring the description of the embodiments.

Unless the context clearly requires otherwise, throughout the description and the claims, the words "comprise," "comprising," and the like are to be construed in an inclusive sense as opposed to an exclusive or exhaustive sense; that is to say, in the sense of "including, but not limited to." Words using the singular or plural number also include the plural or singular number respectively. Additionally, the words "herein," "above," "below" and words of similar import, when used in this application, shall refer to this application as a whole and not to any particular portions of this application. When the claims use the word "or" in reference to a list of two or more items, that word covers all of the following interpretations of the word: any of the items in the list, all of the items in the list and any combination of the items in the list. Any use of the word "means" herein is intended to invoke means-plus-function limitation in accordance with 35 U.S.C. §112, sixth paragraph, even if the word "means" follows words describing the function.

Figures 1, 2:
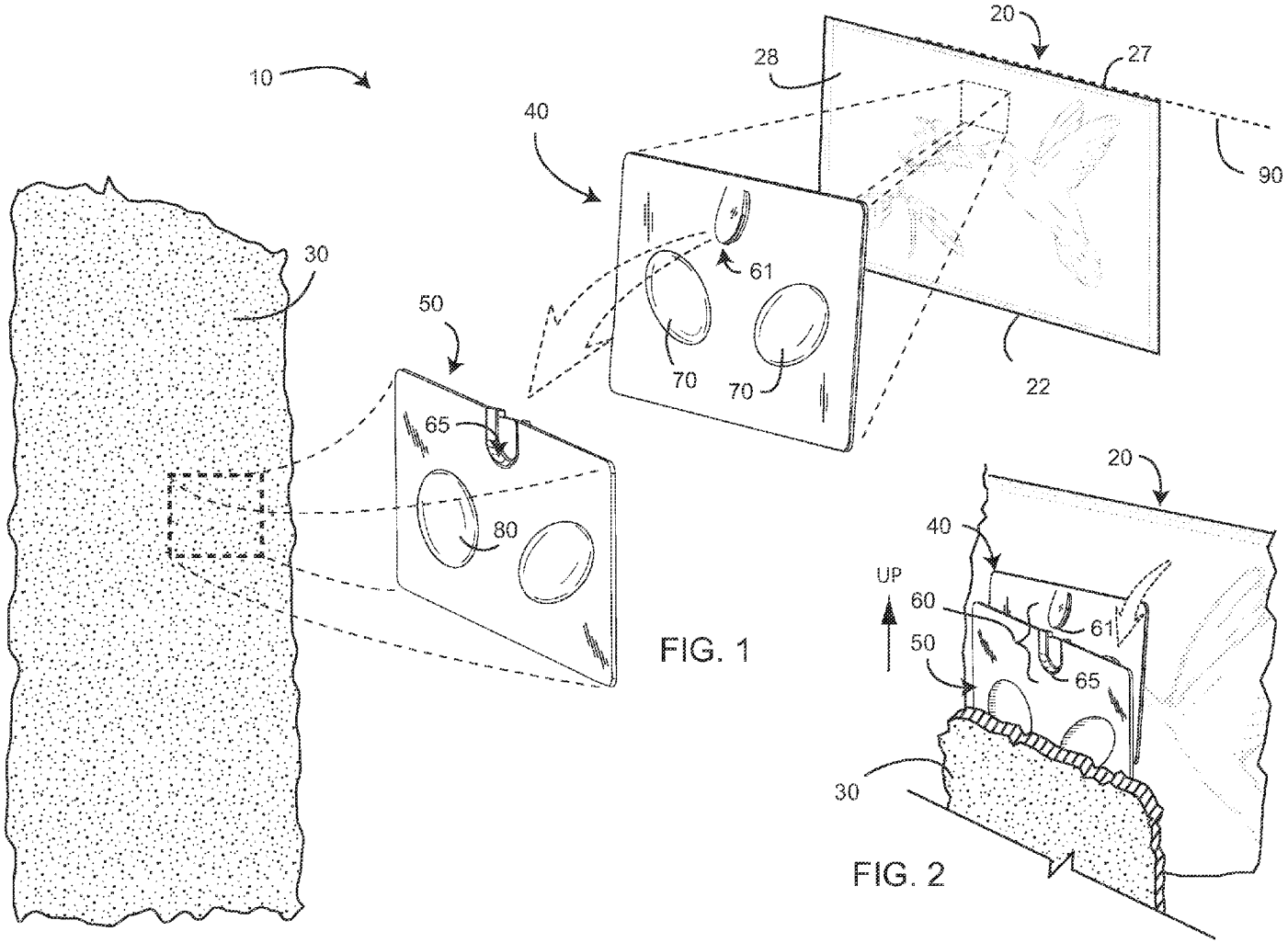
FIG. 1 is an exploded perspective view of a system for securing and maintaining an article in a desired position on a vertical surface.
FIG. 2 is an alternate perspective view thereof.
Figure 15:
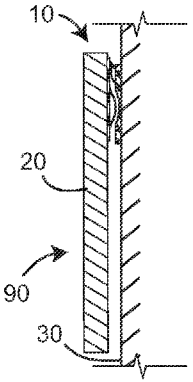
FIG. 15 is a side elevational view of the invention, showing the first and second brackets mutually in the desired position.

FIGS. 1 and 2 illustrate a system 10 for securing a maintaining an article 20, such as a picture frame, in a desired position 90 (FIG. 15) on a vertical surface 30, such as a wall. Typically the desired position 90 is with the article 20 level, for example. Such an article 20 includes at least a rear surface 28, a top edge 27, and a bottom edge 22.

The system comprises a first bracket 40 and a second bracket 50. The first bracket 40 has a first part 61 of a pivot 60 and includes at least one projecting nub 70, and preferably at least two such nubs 70. With the first bracket 40 oriented vertically such that the pivot is towards a top surface thereof, each nub 70 is formed at least partially below the pivot 60 and projecting orthogonally away from a vertical surface 41 (FIG. 8) of the first bracket 40. The first part 61 of the pivot 60 is preferably substantially laterally centered on the first bracket 40, a pair of nubs 70 being formed in the first bracket 40, one nub 70 being formed to either side of the first part 61 of the pivot 60.

Figure 13:
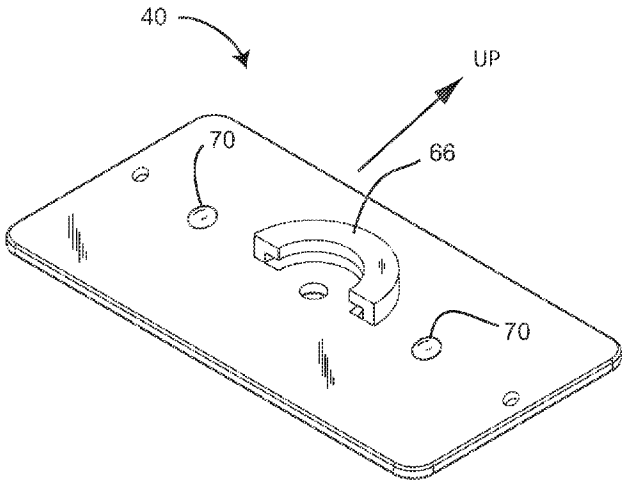
FIG. 13 is a perspective view of an alternate embodiment of the second bracket thereof.
Figure 11:
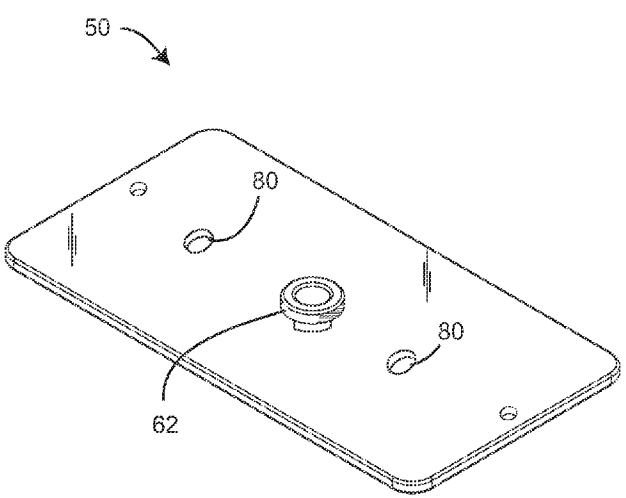
FIG. 11 is a perspective view of an alternate embodiment of the first bracket thereof.

The second bracket 50 has a second part 65 of the pivot 60 and at least one divot 80, and preferably two divots 80, that are each cooperative with one of the at least one projecting nubs 70 (FIGS. 11, 13). With the second bracket 50 oriented vertically such that the pivot is towards a top surface thereof, each divot 80 is formed at least partially below the pivot 60 and projecting orthogonally away from a vertical surface 51 (FIG. 4) of the second bracket 50. The second part 65 of the pivot 60 is preferably substantially laterally centered on the second bracket 50, a pair of divots 80 being formed in the second bracket, one divot 80 being formed to either side of the second part 65 of the pivot 60. Preferably the first and second parts 61,65 of the pivot 60 do not have any significant forward or backward play with respect to each other, and are instead constrained to relatively rotational movement when mutually engaged with gravity holding each part 61,65 together. Further, the terms "engaged" or "fully engaged" refer to the occurrence of one of the nubs 70 being as engaged as possible with one of the divots (or apertures) 80, each nub 70 preferably being substantially the same size or even slightly larger than each cooperative divot 80 so that there is only one unique position 90, that is, just one point of closest mutual approach of the brackets 40,50 as each nub 70 engages and then disengages the divot 80. Further, each divot 80 and/or cooperating nub 70 has a gradual and continuous curvature so as to provide a smooth approach as the nub 70 engages the divot 80.

Figure 12:
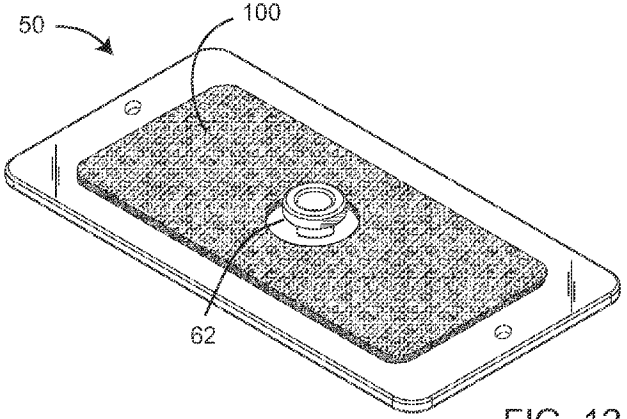
FIG. 12 is a perspective view of another alternate embodiment of the first bracket thereof.

Each bracket 40,50 may be formed from stamping a metal or plastic sheet material, for example, or by injection molding, or the like. The pivot 60 may include a projecting pin 62 that is rotationally captured by the second part 65 of the pivot 60 that includes a cooperative arcuate lip 66 (FIGS. 11-13). As such, the projecting pin 62 may be rested on the arcuate lip 66 to be held by gravity thereby, the projecting pin 62 being free to rotate with respect to the arcuate lip 66. In one embodiment, reference points may be stamped or otherwise formed at the center points along each side of each bracket 40,50. Further, while each bracket 40,50 is illustrated as generally rectangular in shape, any other suitable shape may be utilized. Likewise, while generally oval nubs 70 and divots 80 are illustrated, any suitable shapes may be used provided the corresponding pairs of nubs 70 and the divots 80 cooperate to urge the article 20 into the desired position 90. Regardless, the pivot 60 must be strong enough to support the picture frame on the first bracket 40.

In use, the first and second brackets 40,50 are each fixed to either the rear surface 28 of the article 20 proximate the top edge 27 thereof, or to the vertical surface 30. Either of the first or second brackets 40,50 may be fixed to the article 20, for example, the other bracket 50,40 being fixed to the vertical surface 30. Each bracket 40,50 is fixed to either the article 20 or the vertical surface 30 preferably with common mechanical fasteners 115 (FIG. 4), such as screws or nails, at mounting apertures 110 (FIGS. 8 & 10). Adhesive may also be used, provided the adhesive is strong enough to support the weight of the article 20 and the system 10 on the vertical surface 30 without failing. Each nub 70 of the first bracket 40 engages the cooperative divot 80 of the second bracket 50 when the article 20 is in the desired position 90 on the vertical surface 30, each nub 70, divot 80, and the pivot 60 working in cooperation.

Figure 14:
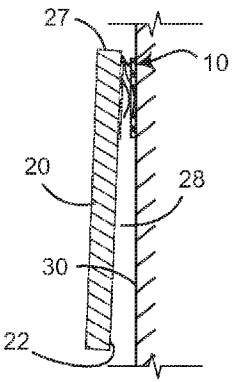
FIG. 14 is a side elevational view of the invention, showing the first and second brackets mutually not in the desired position.

When jarred (FIG. 14), the article 20 pivots back and forth about the pivot 60 until each nub 70 becomes re-engaged with its cooperative divot 80, by gravity, guaranteeing the article 20 will be brought back into the originally installed, desired position 90. The at least one nub 70 is contacting the second bracket 50 outside of its cooperative divot 80, the bottom edge 22 of the article 20 is lifted away from contact with the vertical surface 30. This is in part because the first and second parts 61,65 of the pivot 60 are only mutually free to move rotationally, as opposed to away from each other in depth, and also because the nubs 70 and divots 80 are positioned below the pivot 60 on each bracket 40,50. As such, the bottom edge 22 of the article 20 achieves its closest approach to the vertical surface 30 when the nubs 70 and divots 80 are mutually aligned. Preferably at this closest approach point, the desired position 90, the brackets 40,50 are substantially mutually parallel to each other, and the bottom edge 22 of the article 20 does not contact the vertical surface 30, which would result in frictional contact between the article 20 and the vertical surface 30, which might prevent the article 20 from achieving the desired position 90. The contact points of the at least one nub 70 with the second bracket 50 result in minimal friction, allowing the first and second brackets 40,50 to mutually rotate about the pivot 60 until gravity causes the nubs 70 and the divots 80 to become re-engaged, guaranteeing that the article 20 will assume the desired position 90 when the article is jarred, such as through inadvertent contact, earthquake, or the like.

In one embodiment of the invention, illustrated in FIG. 12, each divot 80 of the second bracket 50 is formed in a malleable material 100, such as "Jolly King" brand plastic clay, model name "Roma Plastilina Very Hard Consistency." Such a malleable material 100 is fixed to the second bracket 50, such that with the first bracket 40 fixed to the rear surface 28 of the article 20 proximate the top edge 27 thereof, and with the second bracket 50 first bracket 40 may be pushed toward the second bracket 50 so that the at least one nub 70 of the first bracket 40 depresses the malleable material 100 to form each cooperative divot 80 of the second bracket 50. The malleable material 100 may be of the type that, once exposed to air, hardens over a predetermined period of time, such that the divots 80 formed therein then become permanently formed. Further, the malleable material 100 has a thickness (not shown) that is less than the distance between the first and second brackets 40,50 when the first and second brackets 40,50 are in the position 90. As such, the malleable material 100 is not squeezed-out between the brackets 40,50 when the nubs 70 are forming the divots 80.

While a particular form of the invention has been illustrated and described, it will be apparent that various modifications can be made without departing from the spirit and scope of the invention. For example, each divot 80 and corresponding nub 70 do not have to be the same size as other divot/nub pairs. Any number of divot/nub pairs may also be utilized, providing the pairs cooperate as herein described. Further, any shape or position of divot/nub pairs may also be utilized, provided at least more pairs are located below the pivot point 60. Accordingly, it is not intended that the invention be limited, except as by the appended claims.

Particular terminology used when describing certain features or aspects of the invention should not be taken to imply that the terminology is being redefined herein to be restricted to any specific characteristics, features, or aspects of the invention with which not be construed to limit the invention to the specific embodiments disclosed in the specification, unless the above Detailed Description section explicitly defines such terms. Accordingly, the actual scope of the invention encompasses not only the disclosed embodiments, but also all equivalent ways of practicing or implementing the invention.

The above detailed description of the embodiments of the invention is not intended to be exhaustive or to limit the invention to the precise form disclosed above or to the particular field of usage mentioned in this disclosure. While specific embodiments of, and examples for, the invention are described above for illustrative purposes, various equivalent modifications are possible within the scope of the invention, as those skilled in the relevant art will recognize. Also, the teachings of the invention provided herein can be applied to other systems, not necessarily the system described above. The elements and acts of the various embodiments described above can be combined to provide further embodiments.

All of the above patents and applications and other references, including any that may be listed in accompanying filing papers, are incorporated herein by reference. Aspects of the invention can be modified, if necessary, to employ the systems, functions, and concepts of the various references described above to provide yet further embodiments of the invention.

Changes can be made to the invention in light of the above "Detailed Description." While the above description details certain embodiments of the invention and describes the best mode contemplated, no matter how detailed the above appears in text, the invention can be practiced in many ways. Therefore, implementation details may vary considerably while still being encompassed by the invention disclosed herein. As noted above, particular terminology used when describing certain features or aspects of the invention should not be taken to imply that the terminology is being redefined herein to be restricted to any specific characteristics, features, or aspects of the invention with which that terminology is associated.

In general, the terms used in the following claims should not be construed to limit the invention to the specific embodiments disclosed in the specification, unless the above Detailed Description section explicitly defines such terms. Accordingly, the actual scope of the invention encompasses not only the disclosed embodiments, but also all equivalent ways of practicing or implementing the invention under the claims.

While certain aspects of the invention are presented below in certain claim forms, the inventor contemplates the various aspects of the invention in any number of claim forms. Accordingly, the inventor reserves the right to add additional claims after filing the application to pursue such additional claim forms for other aspects of the invention.

What is claimed is:

1. A system for securing and maintaining an article in a desired position on a vertical surface, the article comprising at least a rear surface, a top edge, and a bottom edge, the system comprising:

a first bracket having a first part of a load bearing pivot and two projecting nubs projecting orthogonally away from a vertical surface of the first bracket and below the first part of the load bearing pivot; and a second bracket having a second part of the load bearing pivot and two divots each cooperative with and paired with one of the projecting nubs of the first bracket and projecting orthogonally into a vertical surface of the second bracket and below the second part of the load bearing pivot;

whereby with the first and second brackets each fixed to either the rear surface of the article proximate the top edge thereof or to the vertical surface, each nub of the first bracket being engaged with the cooperative divot of the second bracket when the article is in the desired position on the vertical surface, if jarred the article will pivot back and forth until each nub becomes re-engaged with its cooperative divot to bring the article back into the desired position.

2. The system of claim 1 wherein each nub is formed in the first bracket at least partially below the pivot, and wherein each cooperative divot is formed in the second bracket at least partially below the pivot.

3. The system of claim 1 wherein each bracket is formed by metal stamping from a sheet metal material.

4. The system of claim 1 wherein each bracket is formed from a plastic sheet material.

5. The system of claim 1 wherein each bracket is formed from a plastic material through an injection molding process.

6. The system of claim 2 wherein the second part of the pivot is substantially laterally centered on the second bracket and each divot is on opposing sides of the second part of the pivot.

7. A system for securing and maintaining an article in a desired position on a vertical surface, the article comprising at least a rear surface, a top edge, and a bottom edge, the system comprising:

a first bracket having a first part of a load bearing pivot and two non-load bearing projecting nubs projecting orthogonally away from a vertical surface of the first bracket and below the first part of the load bearing pivot; and a second bracket having a second part of the load bearing pivot and two non-load bearing divots each cooperative with and paired with one of the projecting nubs of the first bracket and projecting orthogonally into a vertical surface of the second bracket and below the second part of the load bearing pivot;

whereby with the first and second brackets each fixed to either the rear surface of the article proximate the top edge thereof or to the vertical surface, each nub of the first bracket being engaged with the cooperative divot of the second bracket when the article is in the desired position on the vertical surface, if jarred the article will pivot back and forth until each nub becomes re-engaged with its cooperative divot to bring the article back into the desired position.

8. The system of claim 1 wherein the first and second brackets each further include a plurality of mounting apertures therethrough for fixing each bracket with either the rear surface of the article or the vertical surface with a plurality of mechanical fasteners.

9. The system of claim 7 wherein the first and second brackets each further include a plurality of mounting apertures therethrough for fixing each bracket with either the rear surface of the article or the vertical surface with a plurality of mechanical fasteners.

* * * * *